US005326141A

United States Patent [19]

Gorman

[11] Patent Number: 5,326,141

[45] Date of Patent: Jul. 5, 1994

[54] RETRACTABLE, SELF-LOCKING WINDOW LATCH

[75] Inventor: Wildridge H. Gorman, Gig Harbor, Wash.

[73] Assignee: Milgard Manufacturing, Inc., Tacoma, Wash.

[21] Appl. No.: 80,967

[22] Filed: Jun. 22, 1993

[51] Int. Cl.[5] ..... E05C 5/00

[52] U.S. Cl. ..... 292/66; 292/173; 292/332; 292/DIG. 47

[58] Field of Search ..... 292/332, 334, 173, 66, 292/DIG. 47, 302

[56] References Cited

U.S. PATENT DOCUMENTS

| | | | |
|---|---|---|---|
| 316,098 | 4/1885 | Wethered | 292/332 |
| 316,285 | 4/1885 | McKeen . | |
| 351,575 | 10/1886 | Case . | |
| 817,712 | 4/1906 | Heupel | 292/332 |
| 1,037,302 | 9/1912 | Parent . . | |
| 1,198,862 | 9/1916 | McCormack | 292/332 |
| 1,330,693 | 2/1920 | Fisher . | |
| 1,548,001 | 7/1925 | Furry | 292/332 |
| 1,609,342 | 12/1926 | Winters et al. | 292/332 |
| 1,662,450 | 3/1928 | Anderson . | |
| 1,733,847 | 10/1929 | Wilmot | 292/332 |
| 1,823,807 | 9/1931 | Suckel | 292/332 X |
| 2,142,456 | 1/1939 | Oldham | 292/335 |
| 2,145,112 | 1/1939 | Fedor, Jr. | 292/335 |
| 3,971,580 | 7/1976 | Tantlinger et al. | 292/201 |

*Primary Examiner*—Rodney M. Lindsey

[57] ABSTRACT

A retractable window latch for locking together a first and second window having interlocking meeting rails. The retractable window latch includes a latch body having a faceplate that is substantially flush with a first interlocking meeting rail. A retractable bolt disposed in the latch body extends outwardly through a slot in the faceplate. A handle is coupled to the bolt for retracting the bolt into the latch body. The bolt remains retracted while the first and second windows are open. A flexible release member is disposed behind the faceplate such that the flexible release member engages a second interlocking meeting rail when the first and second windows are closed. The second interlocking meeting rail engages the flexible release member in order to lift the retractable bolt from the slot in the faceplate. A spring forces the bolt outwardly from the latch body to secure the first and second windows together.

10 Claims, 5 Drawing Sheets

RETRACTABLE, SELF-LOCKING WINDOW LATCH

FIELD OF THE INVENTION

The present invention relates to window latches in general and, in particular, to self-locking window latches.

BACKGROUND OF THE INVENTION

In any home or business where security is a concern, it is important that the windows of the home or business be equipped with locking window latches. Common prior art latch designs usually comprise an extendible bolt or a rotatable cam mounted on an inner window that fits into a slot or receiver on an outer window in order to secure a pair of windows together. However, such latch designs suffer from two distinct problems. First, it is necessary to remember to physically close the latch each time the windows are closed in order to be certain that a window is secure. Second, if the window is accidentally moved while the latch is extended or in a locked position, it is possible to scratch the frame of the window or the glass.

To solve these problems, numerous retractable, self-locking window latches have been developed. U.S. Pat. No. 1,037,302 issued to Parent is an example of such a window latch. The latch includes a spring-loaded bolt that remains retracted while the window is open. A specially configured strike releases the bolt when the windows are closed. However, such prior art window latch designs can accidentally be set when the window is open by manipulating the bolt or a handle that moves the bolt, thereby scratching the glass or window frame. Additionally, while such self-locking window latch designs work well for older-style windows, they do not work well for modern window frames. Such windows are designed to have a pair of meeting rails that interlock when the windows are closed to reduce heat or air conditioning loss. Prior art self-locking window latches are not readily adaptable to work with these types of windows. Thus, there is a need for a retractable, self-locking window latch that cannot be accidentally set when the windows are open and work with windows having interlocking meeting rails.

SUMMARY OF THE INVENTION

The present invention is a retractable window latch for locking together a pair of windows having interlocking meeting rails. The latch comprises a latch body that is secured to the frame of a first inner window. The latch body includes a faceplate that is substantially flush with a first interlocking meeting rail of the first inner window. A retractable bolt is disposed in the latch body and extends outwardly through a slot in the faceplate. The bolt has a recessed groove disposed at the outer end of the bolt. A handle retracts the bolt into the latch body such that the recessed groove engages the faceplate. The bolt cannot be extended by manipulation of the handle. Therefore, the bolt remains retracted until the pair of windows is in a fully closed position. A flexible release member is disposed behind the faceplate of the latch body. The flexible release member is engaged by a second interlocking meeting rail of a second outer window when the windows are closed. The flexible release member lifts the recessed groove on the retractable bolt from the faceplate such that the bolt extends outward into a recessed portion or strike of the second outer window, thereby locking the first and second windows together.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
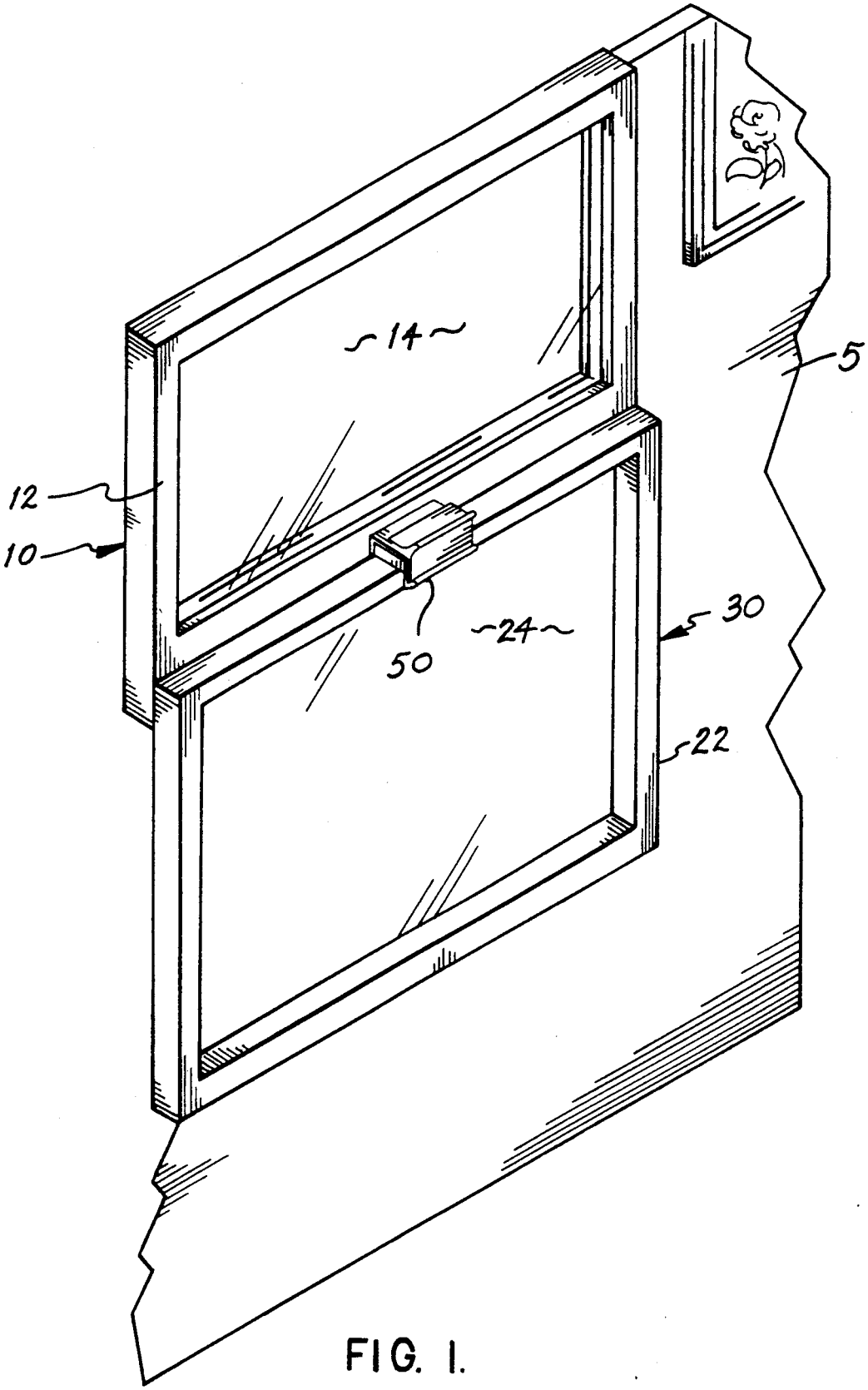
FIG. 1 shows a retractable window latch according to the present invention for locking together a pair of windows.

FIG. 1 shows an outer window 10 and an inner window 30 disposed within a wall 5. The windows 10, 30 can be moved vertically with respect to each other. The outer window 10 includes a frame 12 that supports one or more glass panes 14. Similarly, the inner window 30 includes a frame 22 that supports one or more glass panes 24. As will be discussed in further detail below, each frame 12, 22 includes integrally formed meeting rails (not shown) that interlock with each other when the window is in a closed position. The interlocking meeting rails prevent the loss of heat or air conditioning when the windows are closed.

A latch 50 according to the present invention opens to allow movement of the inner window 30 with respect to the outer window 10. The inner window is opened by first retracting the latch. The latch 50 remains retracted as the inner window 30 is opened and will remain retracted until it automatically locks the inner window to the outer window 10 when the inner window is returned to its closed position. By remaining retracted when the inner window is moved, the latch does not scratch the frame 12 of the outer window or the glass panes 14. Additionally, the latch 50 eliminates the need to remember to manually lock the windows each time the inner window 30 is closed.

Figure 2:
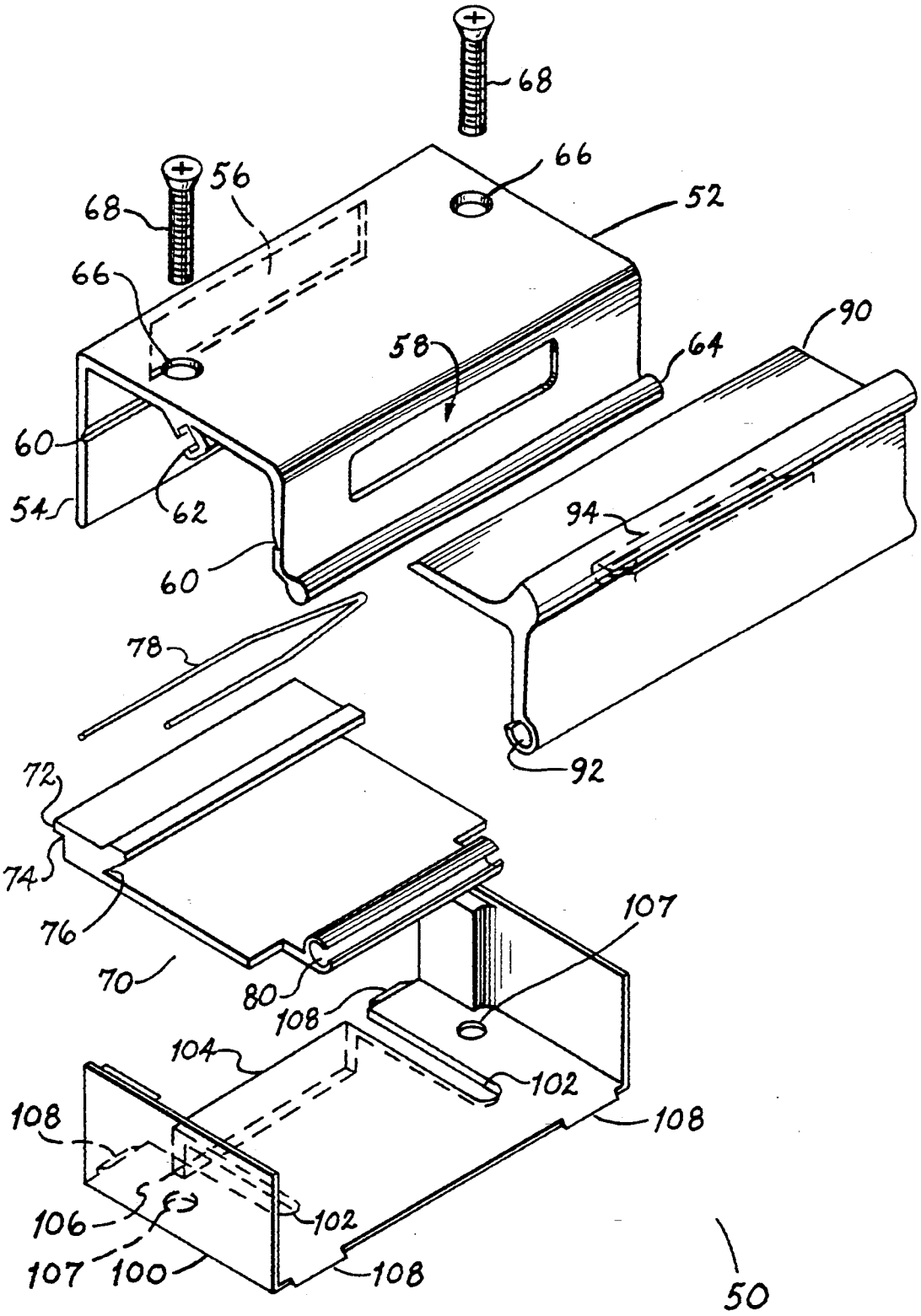
FIG. 2 is an exploded view of the retractable window latch according to the present invention.

FIG. 2 is an exploded view of the window latch 50 according to the present invention. The window latch includes a latch body 52 having a pair of holes 66 disposed therein that receive a machine screw 68 or other fastening means to secure the latch to a window frame. The latch body 52 has a front face 54 with a slot 56 disposed therein. The front face 56 lies substantially flush with the meeting rail (not shown) of the window frame on which the latch is mounted. In order to mount the latch 50 to the window frame, it is necessary to remove a portion of the meeting rail that will be occupied by the front face 54.

A bolt 70 lies within the latch body 52 and extends through the slot 56 when the window is in a locked position. The bolt includes a lip 72 and a recessed groove 74 located below the lip. The bolt also includes a groove 76 in which is placed a spring 78. The other side of the spring 78 fits within a groove 62 which is integrally formed in the latch body 52. The spring forces the groove 74 onto a lower edge of the slot 56 such that the bolt cannot be accidentally extended once the bolt has been retracted. Also, the spring forces the bolt outward when the windows 10 and 30 are closed. Finally, a female connector 80 is disposed at an end of the bolt to secure the bolt to a handle 90.

The handle 90 includes a male connector 94 which cooperates with the female connector 80 to retract the bolt 70 into the latch body. The handle 90 further includes a female connector 92 which cooperates with a male connector 64 that is an integral part of the latch body 52 in order to secure the handle to the latch body. In the present embodiment of the invention, the latch body, extendible bolt and handle are made of aluminum; however, other materials could be used.

The latch 50 further includes a base 100 that fits onto the bottom of the latch body 52. The base is preferably made of a resilient material, such as plastic, and has two slots 102 that form a flexible release member 104 in the base. The flexible release member 104 has a lip 106 that extends downward from an outer edge of the flexible release. The base includes two holes 107 through which the machine screws 68 extend to secure the latch to the window frame. The base 100 further includes a set of tabs 108 which fit into a pair of grooves 60 disposed in the inside of the latch body 52 in order to secure the base 100 to the latch body 52.

Figure 3:
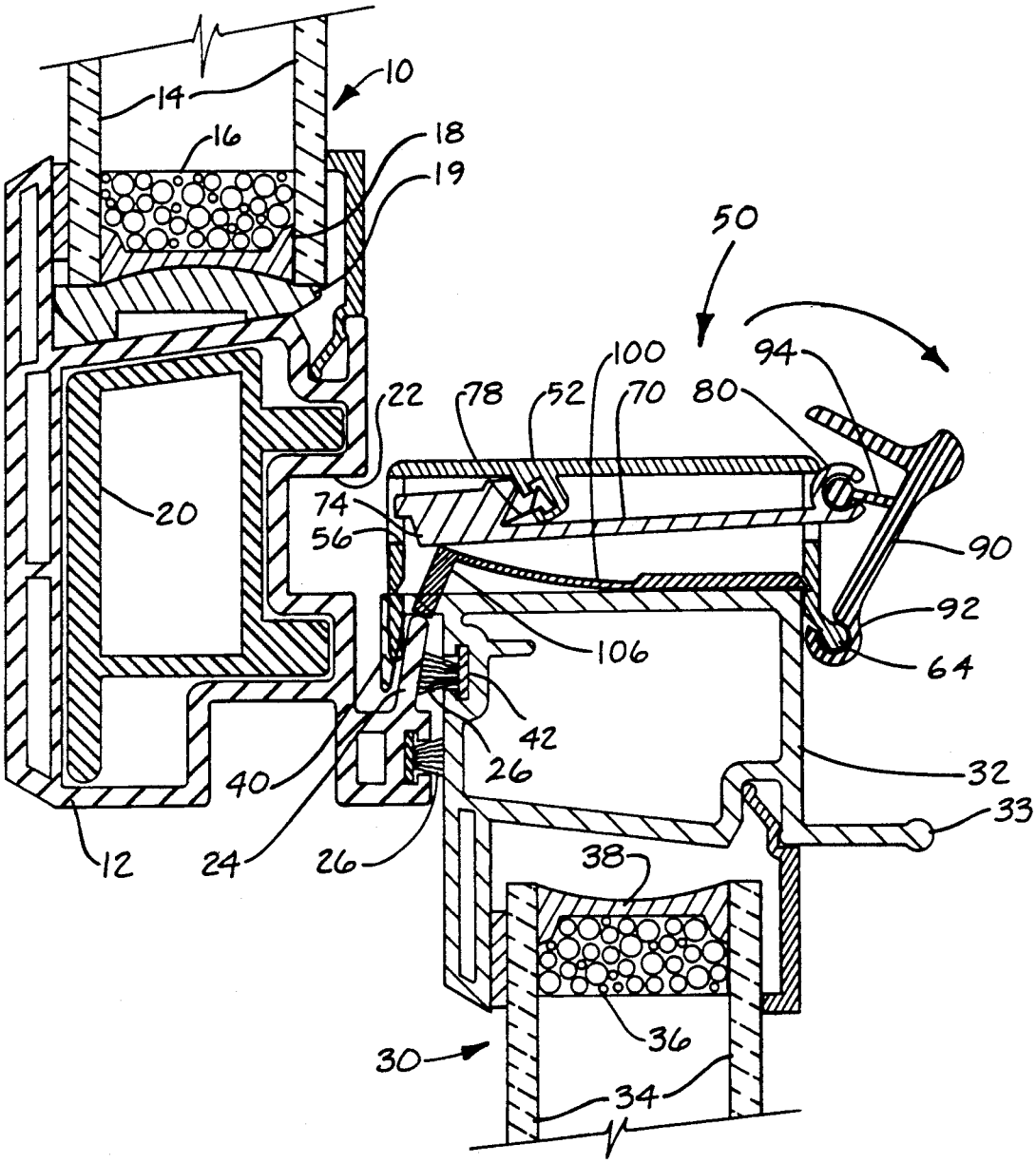
FIG. 3 is a cross-sectional view of the retractable window latch in a manually retracted position for the purposes of opening a window.
Figure 4:
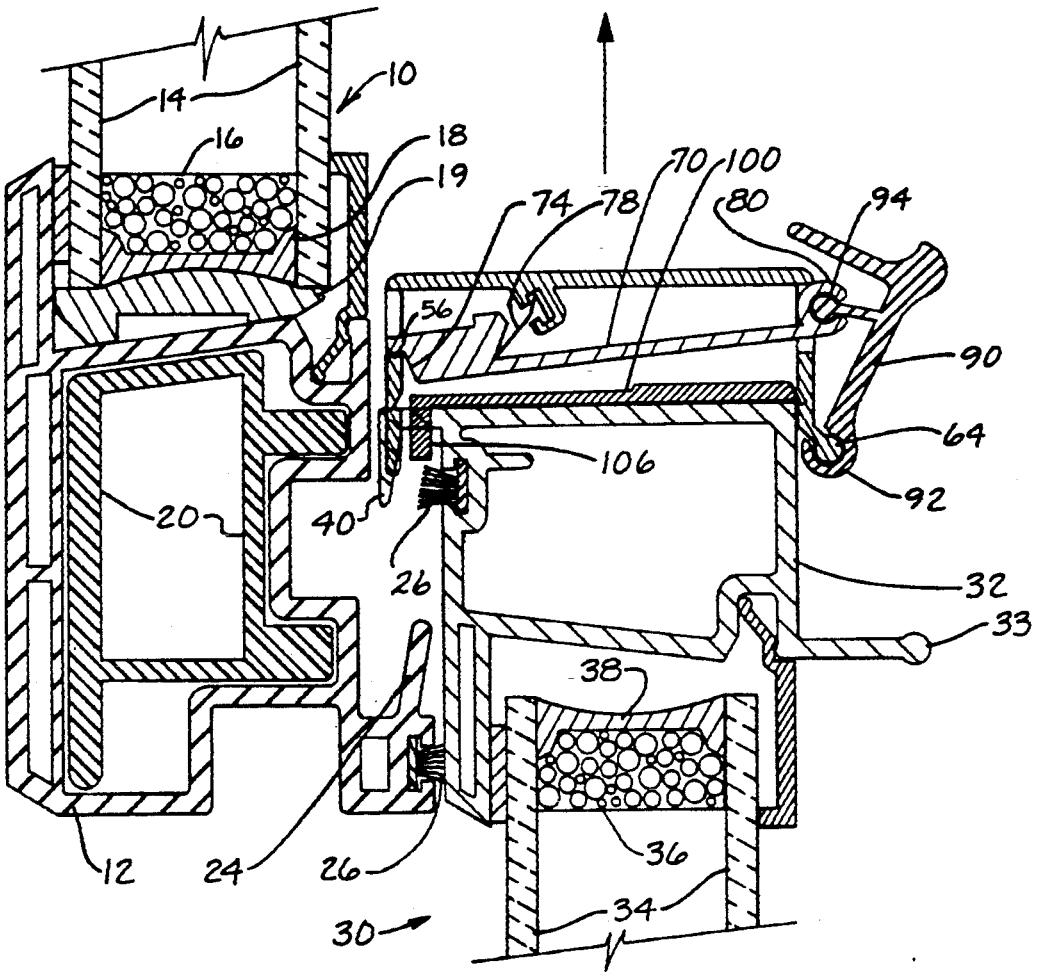
FIG. 4 is a cross-sectional view of the retractable window latch in a retracted position when the window is open.
Figure 5:
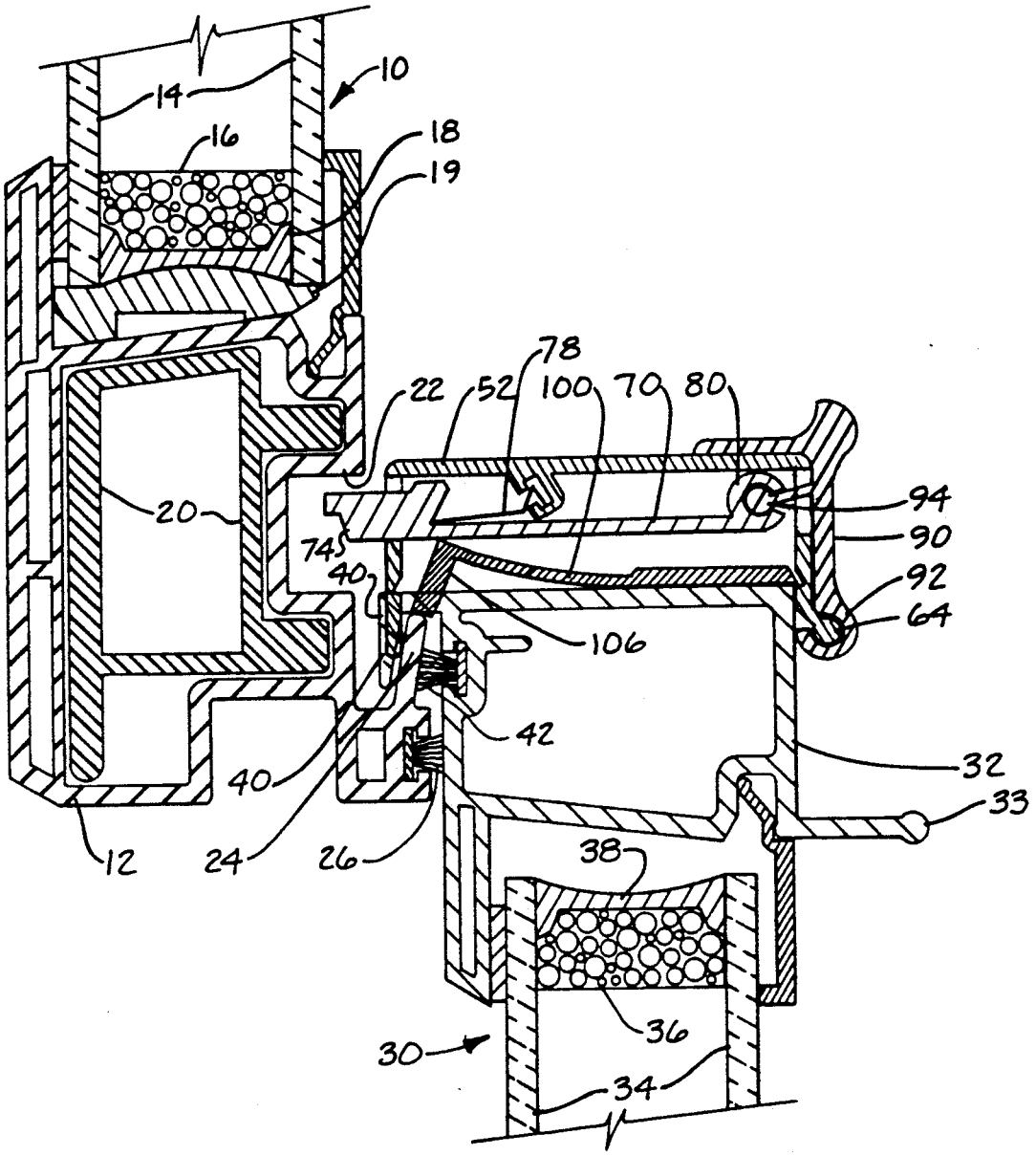
FIG. 5 shows how the retractable window latch according to the present invention is automatically locked when the window is closed.

FIGS. 3, 4, and 5 show how the retractable window latch 50 remains retracted and automatically locks when the windows are closed. FIG. 3 is a cross-sectional view of the outer window 10, the inner window 30, and the window latch 50 according to the present invention. The construction of the inner and outer windows is well known to those of ordinary skill in the art and therefore will only be discussed briefly. The outer window includes a frame 12 that supports a pair of glass panes 14. Disposed between the glass panes is a desiccant material 16 that is surrounded by a rubber strip 18. The desiccant material removes water vapor between the glass panes 14. The window panes 14 rest upon a rubber strip 19, which supports the weight of the panes. Additionally, the window frame 12 may include an aluminum reinforcing member 20 if the size of the window requires additional support than is provided by just the window frame 12. A recessed area 22 is formed in the window frame 12 or a strike may be attached to receive the bolt 70 of the window latch 50 in order to secure the inner and outer windows together. Finally, the window frame 12 includes a meeting rail 24 that interlocks with an opposing meeting rail 40 of the window frame 32 of the inner window 30. The interlocking meeting rails 24 and 40 prevent the loss of heat and/or air conditioning when the windows are closed.

The inner window 30 is constructed in much the same way as the outer window 10. The inner window 30 has a frame 32 which supports a pair of glass panes 34. A desiccant material 36 and a rubber strip 38 lie between the glass panes 34 to remove any moisture between the panes. The window frame 32 also includes an integrally formed handle 33 for raising and lowering the window. As described above, the window frame 32 includes the meeting rail 40, which overlaps the meeting rail 24 when the windows 10 and 30 are closed.

When the inner window 30 is opened, a user pulls the handle 90 outward, thereby retracting the bolt 70 into the latch body 52 and compressing the spring 78 as is shown in FIG. 3. FIG. 4 shows the windows as they are separated. When the meeting rail 24 separates from the meeting rail 40, the lip 106 of the flexible release member 104 extends downward. The spring 78 pushes the bolt 70 downward allowing the groove 74 on the outer end of the bolt 70 to catch on a lower edge of the slot 56 that is disposed in the front face 54. With the groove 74 thus engaged, the bolt 70 remains in the retracted position while the window is opened. The bolt 70 cannot be tripped and remains in the retracted position until the windows are closed.

FIG. 5 shows how the bolt is released when the windows are closed. As the inner window 30 is moved with respect to the outer window 10, the meeting rail 26 engages the lip 106 of the flexible release member 104. The flexible release member 104 is lifted up and engages the bolt 70 to push the groove 74 off of the lower edge of the slot 56. With the bolt lifted, the spring 78 pushes the bolt 70 outward and into the recessed area 22 of the window frame 12. With the bolt 70 extended, the inner window 30 is locked to the outer window 10.

As can be seen, the window latch according to the present invention maintains a retracted position when the windows are moved and automatically locks the windows together when the windows are shut. The latch is activated by the meeting rail 24 of the outer window when the windows are in a closed position. The window latch 50 requires no modification to the outer window frame 12 or specialized strike to release the bolt and is easily mounted to the inner window 30.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A retractable window latch for locking together a first and a second window having interlocking meeting rails, comprising:

a latch body for securing to a frame of the first window, wherein the latch body includes a faceplate for being substantially flush with a first interlocking meeting rail of the first window;

a retractable bolt disposed in the latch body and extending outwardly through a slot in the faceplate, the bolt having a groove disposed at an outer end of the bolt;

a handle coupled to the bolt for retracting the bolt into the latch body such that the groove engages the faceplate;

a spring disposed between the latch body and the bolt for extending the bolt outwardly from the latch body; and a flexible release disposed behind the faceplate of the latch body, wherein the release engages a second interlocking meeting rail of the second window such that the retractable bolt is lifted from the faceplate and extended outwardly from the latch body by the spring.

2. The retractable window latch of claim 1, wherein the flexible release further comprises:

a downwardly extending lip disposed at an end of the flexible release such that the lip meets the second interlocking meeting rail when the first and second windows are closed and lifts the retractable bolt from the faceplate.

3. The retractable window latch of claim 2, wherein the flexible release is made of a resilient material.

4. The retractable window latch of claim 3, wherein the resilient material is plastic.

5. A retractable, self-locking window latch for securing together a pair of windows having interlocking meeting rails, comprising:

a latch body that is attachable to a frame of a first window of the pair of windows, the latch body having a faceplate with a slot disposed therein;

an extendible bolt disposed in the latch body, the extendible bolt having a groove disposed at an outer end of the bolt;

a handle coupled to the extendible bolt for retracting the extendible bolt into the latch body such that the groove on the bolt engages the slot in the faceplate;

biasing means disposed between the extendible bolt and the latch body for extending the extendible bolt through the slot in the faceplate and for causing the groove on the extendible bolt to remain engaged to the slot in the faceplate when the pair of windows are open; and release means that engage an interlocking meeting rail of a second window of the pair of windows to cause the groove on the extendible bolt to disengage the slot in the faceplate.

6. The retractable, self-locking window latch of claim 5, wherein the release means comprises a flexible member disposed behind the faceplate of the latch body.

7. The retractable, self-locking window latch of claim 6, wherein the flexible member is made of plastic.

8. The retractable, self-locking window latch of claim 5, wherein the biasing means is a spring.

9. A retractable, self-locking window latch for locking together a first and a second window having interlocking meeting rails comprising:

a latch body that is attachable to the first window, the latch body having a faceplate with a slot disposed therein, the faceplate for lying substantially flush with a first meeting rail of the first window;

an extendible bolt disposed in the latch body;

a handle for retracting the extendible bolt into the latch body;

means for retaining the extendible bolt in the latch body until the first meeting rail of the first window engages a second interlocking meeting rail of the second window when the first and second windows are closed and said means comprising a groove disposed at an outer end of the extendible bolt;

a flexible release disposed behind the faceplate and underneath the extendible bolt, wherein the flexible release is engaged by the second meeting rail to lift the groove of the extendible bolt off the slot when the first and second windows are closed.

10. The retractable, self-locking window latch of claim 9, wherein the means for retaining the extendible bolt further comprise a spring disposed between the latch body and the extendible bolt that pushes the groove onto the slot disposed in the faceplate when the extendible bolt is retracted into the latch body.

* * * * *